US006082537A

United States Patent [19]

Quinn

[11] Patent Number: 6,082,537

[45] Date of Patent: Jul. 4, 2000

[54] DRAWER TRAY WITH ATTACHMENT ARMS

[76] Inventor: Forrest G. Quinn, 25 Via Lucca, #J-436, Irvine, Calif. 92612

[21] Appl. No.: 09/247,672

[22] Filed: Feb. 9, 1999

[51] Int. Cl.[7] ..... B65D 85/28

[52] U.S. Cl. ..... 206/371; 206/214; 206/224; 108/47; 108/152; 248/229.26; 248/311.2

[58] Field of Search ..... 206/214, 224, 206/320, 371, 561; 220/482; 211/11; 108/46, 47, 152; 248/146, 229.26, 228.7, 231.81, 311.2; 312/351

[56] References Cited

U.S. PATENT DOCUMENTS

| | | | |
|---|---|---|---|
| 1,011,416 | 12/1911 | Day | 206/371 |
| 1,958,266 | 5/1934 | De Foe et al. | 108/46 |
| 3,477,679 | 11/1969 | Lovitz | 248/311.2 |
| 4,620,488 | 11/1986 | Formo . | |
| 4,700,829 | 10/1987 | Goodyear | 206/371 |
| 4,765,575 | 8/1988 | Bergl et al. | 108/152 |
| 5,148,755 | 9/1992 | Morales | 108/47 |
| 5,547,082 | 8/1996 | Royer et al. . | |
| 5,573,116 | 11/1996 | Zink . | |
| 5,924,615 | 7/1999 | McGarrah | 220/482 |

FOREIGN PATENT DOCUMENTS

| | | |
|---|---|---|
| 78897 | 8/1951 | Norway . |

*Primary Examiner*—Paul T. Sewell
*Assistant Examiner*—Luan K. Bui
*Attorney, Agent, or Firm*—Gene Scott-Patent Law & Venture Group

[57] ABSTRACT

A drawer tray for insertion into a desk or bureau drawer is capable of holding small items such as paper clips, buttons and such and provides an attachment device for fixing the tray to a side wall of a drawer with the tray extending into the draw at the top most level of the draw so as not to interfere with items placed near the bottom of the draw. The attachment device provides a set of spaced apart "L" shaped arms for gripping the outside surface of a side wall of the drawer and a set of spaced apart spring arms for pressing against the inside surface of the same side wall.

5 Claims, 2 Drawing Sheets

DRAWER TRAY WITH ATTACHMENT ARMS

BACKGROUND OF THE INVENTION

1. Field of the Invention

This invention relates generally to drawer trays for insertion into desk drawers for holding small items such as paper clips and such, and more particularly to such a drawer tray with attachment arms for clamping the tray to a side wall of a drawer.

2. Description of Related Art

The following art defines the present state of this field:

Royer et al, U.S. Pat. No. 5,547,082 describes a tray for transporting components, such as electronic components. The tray includes a frame and an insert that is releasably secured to the frame. The insert has a plurality of pockets formed therein for storing the components. Inserts having a variety of pocket sizes and arrangements may be secured to frames of a standard size.

Formo, U.S. Pat. No. 4,620,488 describes an improved serving tray that includes a window abutting element which is laterally positionable allowing a window abutting edge to abut with and fulcrum on the outside surface of the window to compensate for variations of the angle of the window to allow the serving platform of the serving tray to be horizontal. The window abutting element is laterally positionable by slideably mounting it to the bottom surface of the serving platform. In its most preferred form, the window abutting element is slideably mounted by arms extending generally parallel to and spaced from the rear legs of the serving tray. The window abutting element is held in one of multiple positions by teeth formed on the bottom surface of the serving platform and formed on the window abutting element. The window abutting element is biased towards the serving platform and is allowed to be moved away from the serving platform to separate the teeth of the window abutting element from the teeth of the serving platform. In its most preferred form integrally therewith and slideable along a connector extending between the arms and the rear legs to bias the window abutting element towards the serving platform and to allow separation of the teeth.

Zink, U.S. Pat. No. 5,573,116 describes a tool tray for organizing and carrying sockets comprising a bottom wall; first and second side walls extending upwardly from the bottom wall; first and second end walls extending upwardly from the bottom wall; first and second handles secured respectively to the first and second end walls and disposed above the bottom wall; a plurality of rails disposed on the bottom wall; and a plurality of clips secured to each of the rails, the clips for removably securing the sockets. The first and second handles each includes a member for permitting a user to securely carry the tray with one hand. Convex shaped flanges are provided on the bottom surface of the bottom wall. A blank for forming the tool tray is also disclosed.

The prior art teaches tray drawers for small parts storage especially in office desks. However, the prior art does not teach that such a tray may be molded as a single integral part with spring arms for firm mounting on a range of wall widths repositioning and removable attachment to a desk drawer side wall. The present invention fulfills these needs and provides further related advantages as described in the following summary.

SUMMARY OF THE INVENTION

The present invention teaches certain benefits in construction and use which give rise to the objectives described below.

The present invention provides a drawer tray for insertion into a drawer for holding small items such as paper clips, buttons and such, and specifically provides an attachment means for fixing the tray to a side wall of the drawer. The attachment means provides a set of spaced apart "L" shaped arms for gripping the outside surface of the side wall of the desk drawer and a set of spaced apart spring arms for pressing against the inside surface of the same side wall.

A primary objective of the present invention is to provide a drawer tray having advantages not taught by the prior art.

Another objective is to provide such a tray with attachment means for fixing the tray by clamping to the top of various widths side walls of the drawer.

A further objective is to provide such a tray with bias means for securing the tray to the side wall strongly yet easily removed as needed and so that the tray may be reversed, i.e., attached alternately to either left or right side walls of the drawer.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
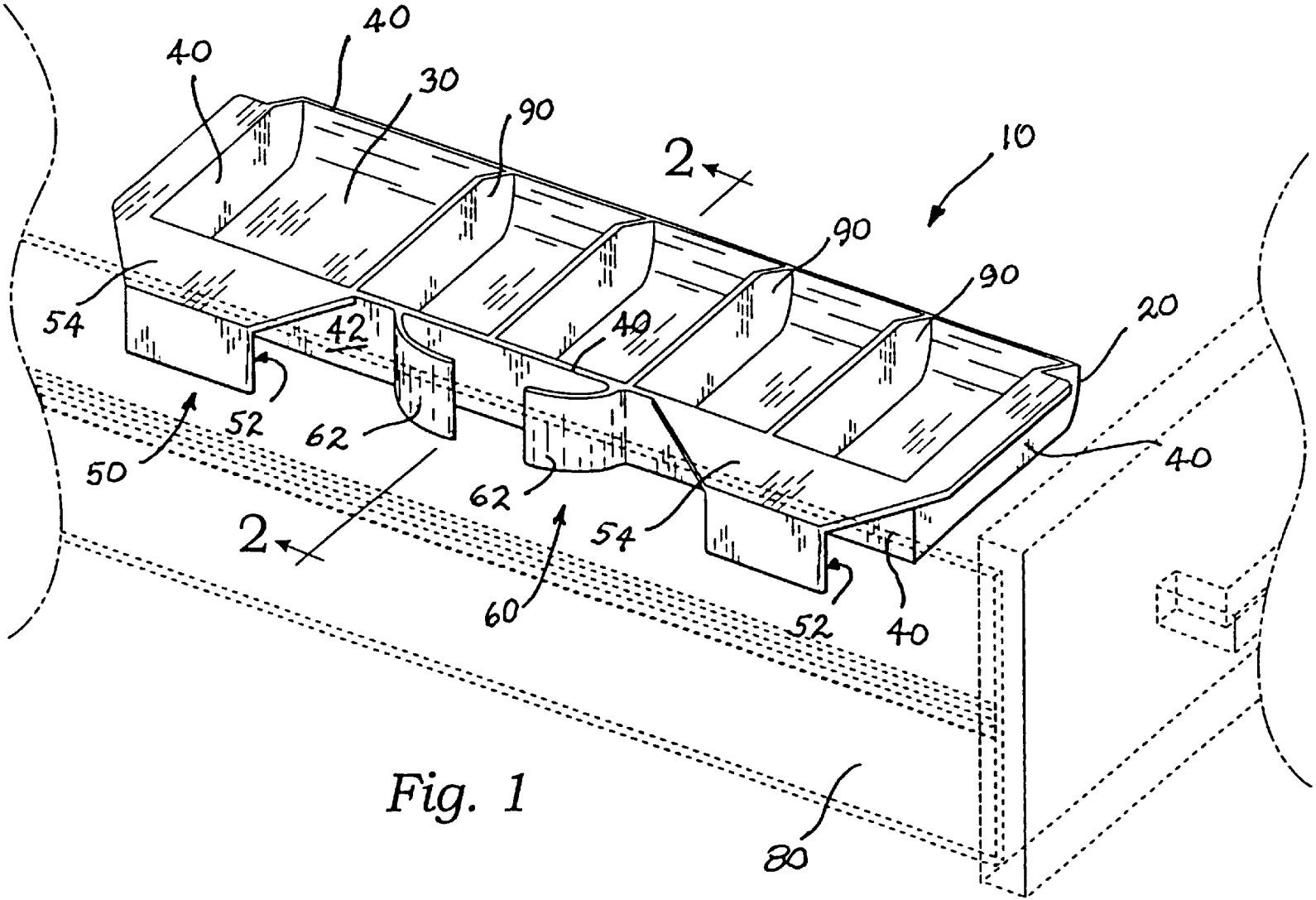
FIG. 1 is a perspective view of the preferred embodiment of the present invention shown in a preferred attachment to a side wall of a drawer.

The above described drawing figures illustrate the invention, a tray apparatus 10 having a one-piece injection molded tray body 20 comprising a tray bottom wall 30 encompassed by a tray sidewall 40, the tray sidewall 40 having an L-shaped at least one L-shaped arms 50 and a bias arm means 60 extending outwardly therefrom, the L-shaped at least one L-shaped arms 50 providing an arm inside surface 52 spaced apart from and in parallel juxtaposition to an outside surface 42 of the tray sidewall 40 defining a fixed space 70 between the arm inside surface 52 and the outside surface 42 of the tray sidewall 40, the bias arm means 60 being positionable, by spring-like bending toward the tray sidewall 40, for fitting a vertical drawer sidewall 80 (not part of the invention) between the bias arm means 60 and the inside surface 52 for clamping the drawer sidewall 80 therebetween. The drawer sidewall 80 may have a range of thicknesses 82 (FIG. 2) depending on the flexibility of the bias arm means 60 but thickness 82 must be smaller than fixed space 70 and preferably about ½ of the fixed space 70.

Inventively, the L-shaped at least one L-shaped arms 50 comprises a pair of laterally spaced apart L-shaped arms 54 as shown in FIG. 1, and the bias arm means 60 comprises a pair of flexible curved arms 62 as also best seen in FIG. 1. Inventively, the pair of curved arms 62 extend from the tray sidewall 40 in mutual convergence, i.e., toward each other, although they could just as easily mutually diverge or both be positioned in the same direction. Inventively, the pair of curved arms 62 are positioned laterally between the pair of L-shaped arms 54 although the reverse arrangement would be equally as functional.

The tray may include, as seen in FIG. 1, a plurality of tray partitions 90 positioned within the tray and integral with the tray bottom wall 30 and the tray side wall 40 for separating the tray into compartments.

Preferably the tray 10 is made of a injection molded plastic and is produced in a single forming step in a injection molding process well known to the art.

Figure 2:
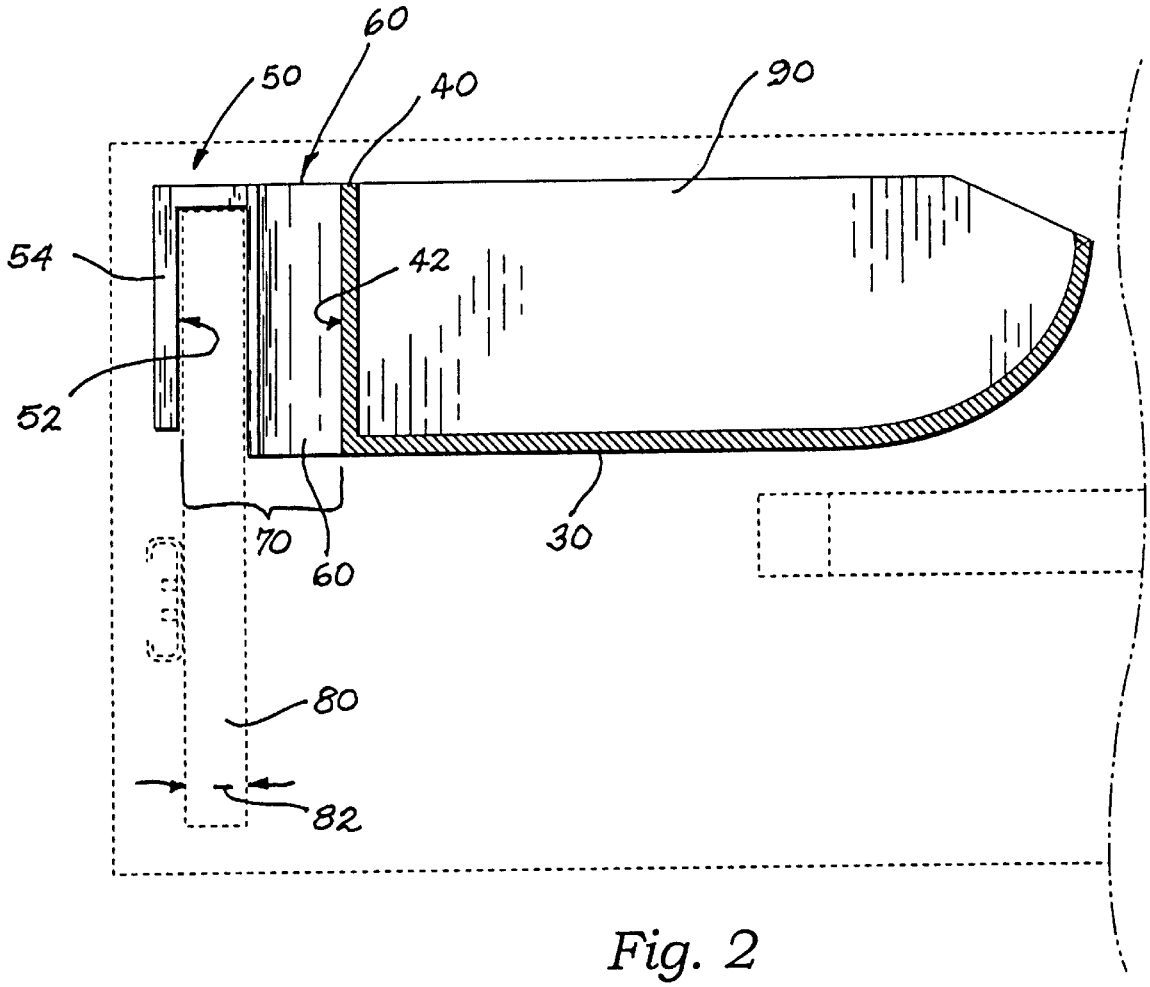
FIG. 2 is a sectional view thereof taken along line 2—2 in FIG. 1.

The tray apparatus 10 may further be described as comprising a tray body 20 providing a tray bottom wall 30 encompassed by a peripheral tray side wall 40, the tray side wall 40 providing at least one L-shaped arms 50, previously described as an arm means, and at least one curved biasing arms 60, previously described as an arm means, extending outwardly therefrom, the at least one biasing arms 60 providing an outwardly facing biasing arms surface 60' spaced apart and in parallel juxtaposition, as is clearly shown in FIG. 2, to an inwardly facing inside surface 52, previously described as a surface means, of the at least one L-shaped arms 50 defining a variable space, which is defined in FIG. 2 as being equivalent and equal to the thickness 82 of the drawer side wall 80, and is between the outwardly facing biasing arms surface 60' and the inwardly facing inside surface 52 of the at least one L-shaped arms 50, the at least one biasing arms 60 being functionally spring action bendable, by virtue of its elasticity, for applying a compressive force on an inside surface 80' of the drawer side wall 80 of a drawer, when the drawer side wall 80 is inserted between the outwardly facing biasing arms surface 60' and the inwardly facing inside surface 52 of the at least one L-shaped arms 50 as is clearly shown in FIG. 2, such that the at least one L-shaped arms 50 is enabled for contact with an upwardly facing edge 84 of the drawer side wail 80 for supporting the tray apparatus 10 thereon when the tray body 20 is positioned within the drawer.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A tray apparatus comprising a tray body providing a tray bottom wall encompassed by a peripheral tray side wall, the tray side wall providing at least one L-shaped arm and at least one curved biasing arms extending outwardly therefrom, the at least one biasing arms providing an outwardly facing biasing arm surface spaced apart and in parallel juxtaposition to an inwardly facing inside surface of the at least one L-shaped arm defining a variable space between the outwardly facing biasing arm surface and the inwardly facing inside surface of the at least one L-shaped arms, the at least one biasing arm being functionally spring action bendable for applying a compressive force on an inside surface of a drawer side wall of a drawer, when the drawer side wall is inserted between the outwardly facing biasing arm surface and the inwardly facing inside surface of the at least one L-shaped arm, such that the at least one L-shaped arm is enabled for contact with an upwardly facing edge of the drawer side wall for supporting the tray apparatus thereon when the tray body is positioned within the drawer.

2. The apparatus of claim 1 wherein the at least one L-shaped arm comprises a pair of laterally spaced apart said L-shaped arm.

3. The apparatus of claim 2 wherein the at least one curved biasing arm comprises a pair of flexible curved arm positioned medially between the pair of laterally spaced apart L-shaped arm.

4. The apparatus of claim 3 wherein the pair of flexible curved arm extend from the tray side wall in mutual convergence.

5. The apparatus of claim 1 further comprising a plurality of tray partitions positioned within the tray integral with the tray bottom wall and the tray side wall for separating the tray into compartments.

* * * * *